United States Patent [19]

Kroneld et al.

[11] 4,274,911

[45] Jun. 23, 1981

[54] METHOD OF COOKING CELLULOSE MATERIAL AND PRESERVING THE HEAT AND TERPENTINE CONTENT OF THE COOKING LIQUOR

[75] Inventors: Erik G. Kroneld; Per-Erik Andersson, both of Sundsvall, Sweden

[73] Assignee: Obbola Linerboard Aktiebolag, Sweden

[21] Appl. No.: 60,930

[22] Filed: Jul. 26, 1979

[30] Foreign Application Priority Data

Jul. 27, 1978 [SE] Sweden ..... 7808198
Aug. 23, 1978 [SE] Sweden ..... 7808897

[51] Int. Cl.[3] ..... D21C 1/02; D21C 11/06

[52] U.S. Cl. ..... 162/15; 159/47 WL; 162/16; 162/47; 162/49; 162/68; 203/22

[58] Field of Search ..... 162/46, 47, 68, 49, 162/15, 16, 14, 19, 239, 240, 246, DIG. 12; 159/47 WL; 202/185 R; 203/88, 22, DIG. 8

[56] References Cited

U.S. PATENT DOCUMENTS

| | | | |
|---|---|---|---|
| 2,870,009 | 1/1959 | Richter | 162/52 |
| 3,432,402 | 3/1969 | Herrlinger et al. | 162/16 |
| 3,816,239 | 6/1974 | Marks | 162/15 |
| 4,033,811 | 7/1977 | Gloersen | 162/246 |
| 4,088,529 | 5/1978 | Ryhman | 162/DIG. 12 |
| 4,111,743 | 9/1978 | Rönnholm | 162/47 |
| 4,137,134 | 1/1979 | Suominen et al. | 162/16 |

OTHER PUBLICATIONS

"Operational Experience about Kamyr 2 Vessel Digester" Yachi; J-TAPPI convention 1977.

Rydholm "Continuous Pulping Processes" TAPPI 1970, pp. 3 and 6.

"Cooking Sulfate Pulp in Installations", pp. 4, 5, 11, 12, Moscow 1966.

*Primary Examiner*—S. Leon Bashore
*Assistant Examiner*—Steve Alvo
*Attorney, Agent, or Firm*—Lerner, David, Littenberg & Samuel

[57] ABSTRACT

A method of cooking cellulose material and effectively preserving the heat and terpentine content of the cooking liquor is disclosed. The cooking liquor is allowed to expand and the expansion steam (blow steam) is conveyed into a bed of cellulose material in a storage container (3', 3) to heat and impregnate the cellulose material before cooking. A heated zone is maintained in the bed of material below the surface of the bed by regulating the flow of expansion steam into the container. Uncondensed, evil-smelling and poisonous gases are at the same time prevented from flowing out into the atmosphere. These gases are drawn off from the storage container for destruction.

18 Claims, 2 Drawing Figures

METHOD OF COOKING CELLULOSE MATERIAL AND PRESERVING THE HEAT AND TERPENTINE CONTENT OF THE COOKING LIQUOR

FIELD OF THE INVENTION

The present invention relates to a method for production of chemical pulp by cooking cellulose material.

The invention is a method of substantially preserving the heat and terpentine content of the steam, which is generated during the expansion of the cooking liquor which is removed from the digester. In connection with cooking in batches the expansion steam, so-called blow steam, goes off from the material during the emptying of the digester. In connection with continuous cooking, liquor is taken out from the digester as extraction liquor which is allowed to expand so that expansion steam is obtained. In both cases a portion of the expansion steam is utilized for heating and impregnating of cellulose material in a storage container prior to the digester.

BACKGROUND OF THE INVENTION

The emptying (blowing) of the digester during cooking in batches takes place in that the contents of the digester are blown out by means of excess pressure to a pulp container. In order that the emptying may be completed quickly and reliably from the process point of view, a relatively high difference in pressure must be maintained between the digester and the pulp container. As a result, released gases and steam, so-called blowing steam, go off from the pulp.

Besides water vapour, the blowing steam contains, inter alia, terpenes, evil-smelling gases such as methylmercaptan, dimethyl sulphide, dimethyl disulphide and hydrogen sulphide, as well as nitrogen, carbon monoxide and carbon dioxide. Moreover, several of these gases are poisonous.

The usual method of handling the blowing steam is to cool it down so that the greater part of the condensable gases condense, the steam-forming heat which is released during the condensation being used for the production of hot water which is utilized as far as possible in other processes. The gases which do not condense are greatly contaminated and are generally destroyed by burning.

The disadvantages of this method are that the heat and terpentine content of the blowing steam is partially lost because the production of hot water is greater than the demand in the manufacturing processes and some of the terpenes go off with the non-condensed gases.

The reason why the blowing steam has not been used for preheating of cellulose material before the digester is that the amount of blowing steam which goes off at the beginning of the emptying of a cook is much greater than at the end of the emptying. The pressure in the blowing-steam system varies to a corresponding extent. If the pressure in the system varies much, there is a risk of aftercooking in the pulp container at low pressure in the system, that is to say between two digester blows. A powerful aftercooking leads to cellulose material being drawn into the blowing steam system with the gases where it can cause disturbances in the process.

Between two digester blows, the pressure in the blowing steam system sinks so low that a partial vacuum can form. Cold air is then drawn in, so that cellulose material which has previously been preheated is cooled down again. At the same time, there is a risk of exploding because the mixture of gas and air can be explosive.

The usual method of continuous cooking (sulphate cooking) means that the wood chips from a small chip bin are conveyed to a steaming vessel for preheating with flash steam and low-pressure steam. At the same time, steam and air are extracted from the steaming vessel and conveyed to a terpentine recovery system where the steam is condensed together with the terpentine in the steam. The terpentine is separated in a terpentine decanter.

The wood chips are fed into a digester together with white liquor and the cooking takes place in known manner. A usual method is to wash the cooked cellulose material in the lower part of the digester by extraction counter-currently with a washing liquid. The pulp is discharged at the bottom of the digester and the liquor is taken out as extraction liquor from the upper portion of the washing zone. The temperature of the liquor drops through spontaneous evaporation in two or more pressure expansion stages, or flash cyclones. Steam formed is utilized for heating-up purposes, steaming wood chips in the steaming vessel and for the production of hot water. Usually steam from the first flash stage is used for steaming wood chips in the steaming vessel, while steam from the other flash stage is used for heating up streams of liquor or for the production of hot water.

During recent years, chip bins have begun to be installed for preheating chips with flash steam from the last flash stage or stages to reduce the consumption of steam at high pressure.

It is well known that the recovery of terpentine from installations for continuous sulphate cooking provides a low yield of terpentine. The terpentine is supplied to the process with the wood. Steam and air are extracted from the steaming vessel and are conveyed to a terpentine recovery system, where the steam is condensed. The terpentine which is recovered from the steaming vessel comes partly from the wood chips, partly from the flash steam which is used for the steaming of the chips. Since the terpentine in the chips is very inaccessible and the time it remains in the steaming vessel is short, only a small portion of the terpentine content of the wood can be driven off. Since the extraction steam contains air, some of the terpentine accompanies the air out into the atmosphere after cooling. Thus the fact that the steam contains air reduces the terpentine yield. The greater part of the terpentine follows the wood into the digester and is transferred into liquor during the cook. The terpentine is then driven off during the flashing of the liquor after the digester and during evaporation in an evaporation plant. When this steam condenses, the terpentine also condenses and is present mainly emulsified in condensate from the digestion and evaporation plant.

In connection with the cook, volatile constituents are formed such as evil-smelling sulphur compounds and methanol. They are driven off like the terpentine and are present together with terpentine in certain condensate fractions in the digesion and evaporation plant. Inert gases are also present in the system and are continuously drawn off. These streams also contain terpentine and other volatile, evil-smelling compounds.

The streams of gas containing terpentine and evil-smelling gases are collected and destroyed by burning. Since these vapours mixed with air are explosive, it is important to prevent air from entering the system. As already pointed out earlier, the vapours leaving the terpentine recovery contain both air and terpentine. They therefore constitute a potential safety risk.

The condensate which contains terpentine, evil-smelling compounds and methanol, is likewise collected, conveyed to a distillation column where the volatile compounds are driven out after which they are destroyed by burning. A large proportion of the terpentine supplied is thus burned. At best, therefore, only the fuel value of the terpentine is used. Terpentine is a valuable raw material for chemical production, however, and as such has quite a higher value. It is possible to recover terpentine after the distillation column by cooling and separation. This terpentine contains so many impurities, however, that its value is limited.

SUMMARY OF THE INVENTION

The object of the present invention is to eliminate the above disadvantages in cooking in batches and in continuous cooking, respectively. According to the present invention expansion steam (blow steam) is utilized for heating of the cellulose material, the flow of steam being regulated so that it is possible to increase the yield of terpentine, while at the same time uncondensed, evil-smelling and poisonous gases are collected in such a manner that they can be handled and destroyed without risk of explosion.

The invention is based, inter alia on observations which were made in experiments to heat a chip column with steam containing terpentine and evil-smelling organic sulphur compounds formed during sulphate cooking.

A chip column serves as a very good heat exchanger and is easily heated by steam. If steam containing terpentine and organic sulphur compounds is supplied continuously to a cold chip column at the bottom of the chip column and evenly distributed over the cross-sectional area of the chip column, the following occurs.

A. The air present in the chip column is displaced by the incoming mixture of vapour and gas.

B. The main part of incoming sulphur compounds is adsorbed on the cold chips.

C. Practically all the terpentine condenses on the cold chips.

D. The steam condenses on the cold chips, the chips being heated.

E. Some of the volatile sulphur compounds, and under certain conditions a large part of these, is driven out again from the hot chips.

F. The heating takes place in the form of a temperature front which moves up through the chip column. In this temperature front a temperature gradient is obtained, the extent of which is only a few tenths of a meter when the temperature rises from the temperature of the cold chips to about 100° C.

G. This temperature front drives in front of it a zone containing organic sulphur compounds with a small air content.

H. The terpentine remains in the hot zone below the temperature front, since there is no flow of steam which can convey the terpentine into the cold zone.

During continuous cooking according to the invention, the evil-smelling vapours and gases are collected and conveyed to a storage container for cellulose material situated before the steaming vessel. The cellulose material is preheated in this container with steam containing terpentine in the form of flash steam from one of the expansion stages for extraction liquor. By supplying steam in the lower part of the container, a horizontal temperature front is obtained in the container. The supply of steam is controlled so that a heated zone is obtained in the lower part of the container and a cold temperature zone in the upper part of the container. The temperature gradient is controlled so that the temperature front never reaches the upper boundary surface of the bed of material.

With such a method, terpentine supplied accompanies the hot chips down into the steaming vessel after which it can be recovered in a terpentine recovery plant in known manner. As a result of the fact that the air and a large proportion of the uncondensable gases are displaced, the terpentine recovery plant provides a considerably better terpentine recovery than the prior art. At the same time, a small amount of the sulphur compounds supplied collect in the cold part of the container, so that the air is displaced. This evil-smelling gas can be conveyed to destruction by burning or other means, without risk.

As stated above, a large proportion of the terpentine is present in various condensates together with evil-smelling sulphur compounds and methanol. According to the prior art, this condensate is collected and distilled with steam, after which a concentrated mixture of steam and said compounds in the gas phase is destroyed by burning. In the course of this, much terpentine is lost. The present invention means that the terpentine can be recovered in a valuable form instead.

The concentrated gases from the distillation column cannot be conveyed directly to the storage container for terpentine recovery. Then the methanol included would accumulate on the hot cellulose material and there would thus be a continued enrichment with methanol in the black liquor system. The methanol would not be able to leave the system. At the same time, the amount of oganic sulphur compounds would increase in the terpentine recovery system, which is unsuitable. The condensate must therefore be treated so that the terpentine is separated from the main part of the methanol in the condensate and its organic sulphur compounds.

In the condensate, the terpentine is present in a separate liquid phase while the sulphur compounds and methanol are wholly or partially dissolved in the liquid phase of the condensate.

The driving off of terpentine takes place as a steam distillation. Theoretically only about 1 kg of steam is needed per kg of terpentine for driving off at 100° C. and only one distillation plate. Methanol and the organic sulphur compounds which are dissolved in the water phase are present in dilute form. In order to drive off these substances, a column with many theoretical plates is needed and very large amounts of steam, in comparison with that needed for driving off the terpentine.

In accordance herewith the possibility of separating the terpentine from the other components is offered. Condensate containing terpentine is collected and conveyed to a terpentine stripper comprising only a few distillation plates. The amount of steam is regulated so that all or the main part of the terpentine is driven off. The vapours are conveyed to the storage container for preheating of the cellulose material where the terpentine is adsorbed on the material, goes to the steaming vessel and again to the terpentine recovery plant. Flash steam from the extraction liquor may appropriately be used as steam. The condensate is conveyed together with other evil-smelling condensates not containing terpentine to a methanol stripping column, the vapours of which are conveyed straight to destruction.

As a result of this procedure, the terpentine is returned to the cellulose material and the steaming vessel. The returned terpentine is present in vapour form or in an easily accessible form in the steaming vessel and can easily be drawn off from the steaming vessel. In the terpentine stripper, the most volatile sulphur compound, hydrogen sulphide, is mainly driven off. Since this has a value as sulphide sulphur during the cooking, this is also a positive technical effect.

The characteristics of the invention can be seen from the patent claims.

BRIEF DESCRIPTION OF THE DRAWINGS

The invention will be described below with reference to the figures, which show diagrammatically two arrangements.

Other arrangements are naturally conceivable within the scope of the idea of the invention.

DETAILED DESCRIPTION

Figure 1:
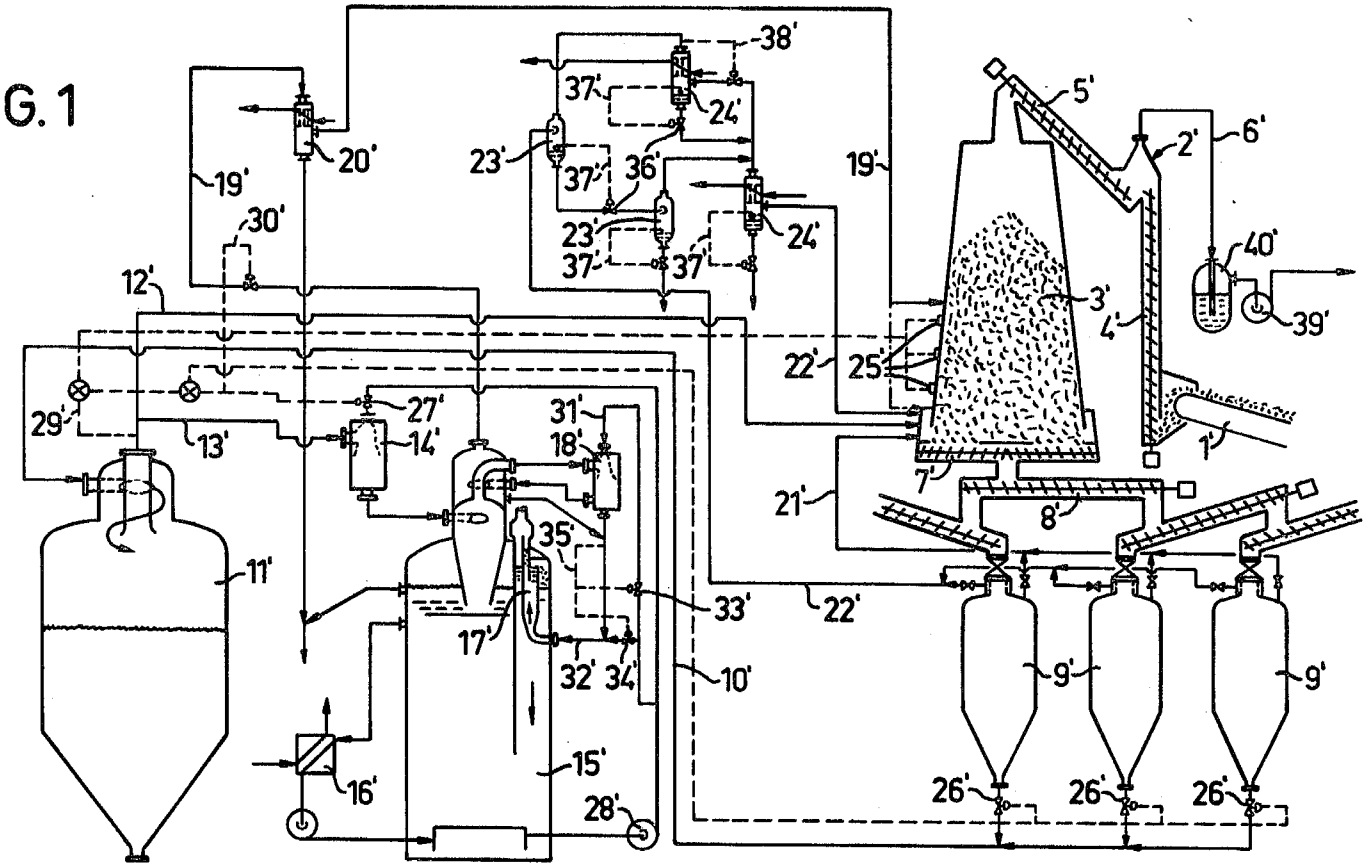
FIG. 1 shows diagrammatically an arrangement in accordance with the present invention for handling expansion steam (blow steam) during cooking in batches.

According to FIG. 1 cellulose material in the form of wood chips is fed by a conveyor 1' to a feed device 2' which introduces the wood chips into the upper part of a closed storage container 3'. The feed device comprises two screw feeders 4' and 5' placed one behind the other, a pipe 6' intended for ventilation being connected between the screw feeders.

The screw feeders 4', 5' are designed so that the wood chips are fed in the form of a "plug" which prevents other air from that which is normally found in a bed of wood chips from being allowed to accompany the material through the screw feeder 4' and that gas from the storage container 3' is prevented from flowing freely through the screw feeder 5'. As a result of the fact that the pressure in the vent 6' is kept lower than in the storage container 3', the air in the screw feeder 4' is prevented from accompanying the wood chips to the storage container 3'. The gases from the storage container 3' are conveyed in counter-current to the wood chips to the vent 6', remaining terpenes in the gas condensing on the wood chips.

Placed in the bottom of the storage container 3' is a discharge device 7'. This device 7' feeds the wood chips to a closed transport system 8' which leads to a number of digesters 9'. From the bottom of the digesters 9', an emptying pipe 10' goes to a pulp container 11'. Two pipes 12' and 13' for blowing steam go from the pulp container 11'. The first pipe 12' goes to the storage container 3' and is connected to the lower part of this container. The other pipe 13' goes via a condenser 14' to a condensate container 15'. The condensed blowing steam is collected in the condensate container 15' which is in the form of a so-called "accumulator". A high condensate temperature is maintained in the upper part of the condensate container. By means of a heat exchanger 16', hot water can be produced as a result of the fact that the hot condensate from the upper part of the condensate container 15' flows through the heat exchanger 16' where it surrenders some of its heat content. The cooled condensate is then returned to the lower part of the condensate container 15'.

The condensate container 15' is in communication with the atmosphere via a liquid lock 17'. Within the pressure variations for which the liquid lock 17' is designed, on the one hand air is prevented from entering the condensate container and hence the blowing steam system, which could result in cooling down, particularly in winter time, as well as a risk of explosion, and on the other hand blowing steam is prevented from forcing its way out into the atmosphere where it would impair the environment while at the same time its energy content would be lost. In the event of a faulty manoeuvre in the process, it may happen that the liquid lock 17' is blown out or filled with pulp on a massive overflow from the pulp container 11'. In order to prevent emptying of the liquid lock 17', or its blockage with pulp, condensate is conveyed continuously through the lock. The liquid is taken either from an after condenser 18' or directly from the bottom of the condensate container 15', after which the condensate is conveyed back to the bottom of the condensate container. The gases which are not condensed in the condensate container 15' are conveyed through a pipe 19' to the storage container 3', via an after cooler 20', which cools the gas to a temperature somewhat above the condensing temperature of the terpentine.

Connected to the upper part of the digesters 9' is a pipe 21'. This pipe leads to the storage container 3' and is used during filling of the digesters so that the displaced gases are taken back to the storage container 3'. Another pipe 22' is connected to the upper part of the digesters. In this manner the digesters are degassed during the course of the cooking. This pipe passes through devices 23' for separating liquor and devices 24' for heat exchange of gassing steam and recovery of terpentine. The liquor is conveyed back to the cooking process, the terpentine and water vapour are condensed after which it is conveyed to terpentine decanting and the remaining non-condensed gases are conveyed back to the storage container 3', where remaining terpentine vapour condenses on the wood chips.

If the organic sulphur compounds formed in the digesters have such vapour pressures that they will condense in the storage container 3' and will be driven off from the upper part of the digesters 9' during the chip filling of the digesters these compounds will be enriched in the lower part of the storage container. Such an enrichment can be prohibited by cooling all or a part of the expelled gases in the pipe line 21' in a heat exchanger before they are sent to the storage container 3'. The condensates from this heat exchanger can be sent to the turpentine decanter.

If the gases from the evaporation plant of the factory contain a considerable amount of terpentine, these gases may also be conveyed into the storage container 3', possibly after removal of hydrogen sulphide, the terpentine being recovered.

The air and gas which is removed from the screw feeders 4' and 5' via the pipe 6' are conveyed away for possible destruction by means of a blower or pump device 39'. In order to prevent blockage of the device 39' with cellulose material, a liquid lock 40' may appropriately be disposed between the storage container 3' may appropriately be disposed between the storage container 3' and the device 39'. The liquid in the liquid lock 40' is circulated continuously as a result of the fact that liquid is flushed in at the top of the pipe 6' and spreads over to an outflow device. Since the mixture of gas and air which is conveyed through the pipe 6' may be explosive, for example in the event of a faulty manoeuvre or when restarting, the conveying should be effected in such a manner that spark formation is avoided. The blower or pump device 39' which is used should therefore be so designed and mounted that it cannot cause spark formation in the conveyed gases.

As a result of the fact that blowing steam is conveyed from the pulp container 11' and non-condensed gases from the condensate container 15', the terpentine gassing device 24' and possibly from the evaporation to the storage container 3', the effect is achieved that on the one hand the wood chips are heated up before the digesters and on the other hand terpentine is condensed on the wood chips. The terpentine is returned to the cooking process and can be recovered during the gassing during the course of the cooking.

The blowing steam which is introduced directly or indirectly into the lower part of the storage container 3' flows upwards through the bed of wood chips, the wood chips being heated and the blowing steam being cooled. When the blowing steam, which contains inter alia inert gas, terpentine and organic sulphur compounds, cools and the condensable gases condense according to their partial pressure for the temperature prevailing, there is obtained on the one hand a condensate phase consisting of a water phase and a terpentine phase and on the other hand a gas phase. Practically all the terpentine and the greater part of the organic sulphur compounds are found at first in the condensate phase. Since the temperature in the wood chips rises, however, a large proportion of the organic sulphur compounds is driven out of the cndensate phase and is found above the bed of wood chips in the storage container 3'. If the temperature is allowed to rise in the whole bed of wood chips, the terpentine is also driven out of the condensate. Therefore a heated zone is always maintained in the bed of chips in the storage container 3', the upper surface of the zone always being below the upper surface of the bed of wood chips. As a result the terpentine is prevented from flowing through the bed of chips and being lost and the risk of explosion decreases. At the same time the energy content of the blowing steam is prevented from being lost. This is brought about in that temperature-detecting members 25' are placed at various levels in the storage container 3'. By means of signals from these members 25', the condenser 14' is controlled and so the amount of blowing steam which is conveyed through the pipe 13'. As a result, the amount of blowing steam which flows through the pipe 12' to the storage container 3' and heats up the bed of chips is regulated.

The uncondensed gases from the condensate container 15', the pressure of which has been reduced by the pressure drop in the equipment through which the gases pass, may appropriately be conveyed at separate heights into the bed of wood chips. Gases with a high content of steam can be introduced low into the bed of chips and gases with a low content of steam at a level situated higher up, possibly above the heated zone below the surface of the bed of wood chips. Gases with a low content of steam can also be introduced above the surface of the bed, since the terpenes condense on the wood chips on their way counter-currently through the "plug" in the screw feeder 5'.

When each digester 9' is emptied, a valve 26' is opened in its bottom so that the pulp is blown through the emptying pipe 10' to the pulp container 11'. In order to reduce the effects of the first blasts of steam at the beginning of a blow, a signal goes from the valve 26' or from a point in the blowing pipe 10' common to all the digesters to a valve 27' which regulates the supply of liquid to the condenser 14'. This valve then opens and cold condensate is pumped with a pump 28' from the lower part of the condensate container 15' to the condenser 14'. An amount of blowing steam which corresponds to the amount of cold liquid is then sucked in through the pipe 13' to the condenser 14', so that the first pressure surge of the digester blow is reduced. After the first pressure surge has been reduced in the condenser 14', the valve 27' is regulated by a pressure-detecting member 29' in the blowing-steam pipe to the pulp container, the pressure in the blowing system only being allowed to swing within narrow limits. If the temperature level in the storage container 3' is too high, the temperature-detecting member 25' takes over the regulating function for the valve 27', whereupon blowing steam is conveyed to the condenser 14' until the correct temperature level is reached in the storage container 3'.

In order to regulate the flow of condensed gases from the condensate container 15', there is a regulating valve 30' in the pipe 19'. The function of the valve 30' is to open at the same time that the valve 27' has received the signal to open, whereupon the uncondensed gases from the condensate container 15' are allowed to go away when the condenser 14' is in operation but are held cut off when all the blowing steam is going through the pipe 12' to the wood chips in the storage container 3'.

The pump 28' which pumps "cold condensate" to the condenser 14' also supplies liquid to the aftercondenser 18' through a pipe 31'. The cooling liquid for the condenser 18' is regulated by the outgoing temperature through a regulating member 35' and is conveyed through a pipe 32' to the liquid lock 17' and back to the cold part of the condensate container 15'. When the flow of liquid through the condenser 18' is reduced, as a result of the fact that a valve 33' in the pipe 31' is closed, a regulating valve 34' is opened in the pipe 32' so that the pump 28' is brought into direct communication with the liquid lock 17' As a result, a constant flow of liquid is ensured through the liquid lock 17'.

Devices 23' for separating cooking liquor from "terpentine gassing" are constituted by containers in the form of cyclone separators, where the separated cooking liquor is conveyed back to the process and the gases which, apart from water vapour contain inter alia large amounts of terpentine together with organic sulphur compounds are conveyed to the heat exchangers 24'. In the first of these heat exchangers, which is held under excess pressure by a pressure-regulating member 39' and a level-regulating member 37', the charge of liquor for the digesters is preheated. The other heat exchangers, which condense the terpentine gases, are regulated by means of cold water and a level-regulating member 37'.

Instead of drawing off the rest of the blowing steam to a condenser and a condensate container to control the amount of blowing steam for preheating of the cellulose material, the rest of the blowing steam can be drawn off to an accumulator. The amount of blowing stream is then controlled by regulating the pressure in the accumulator.

Figure 2:
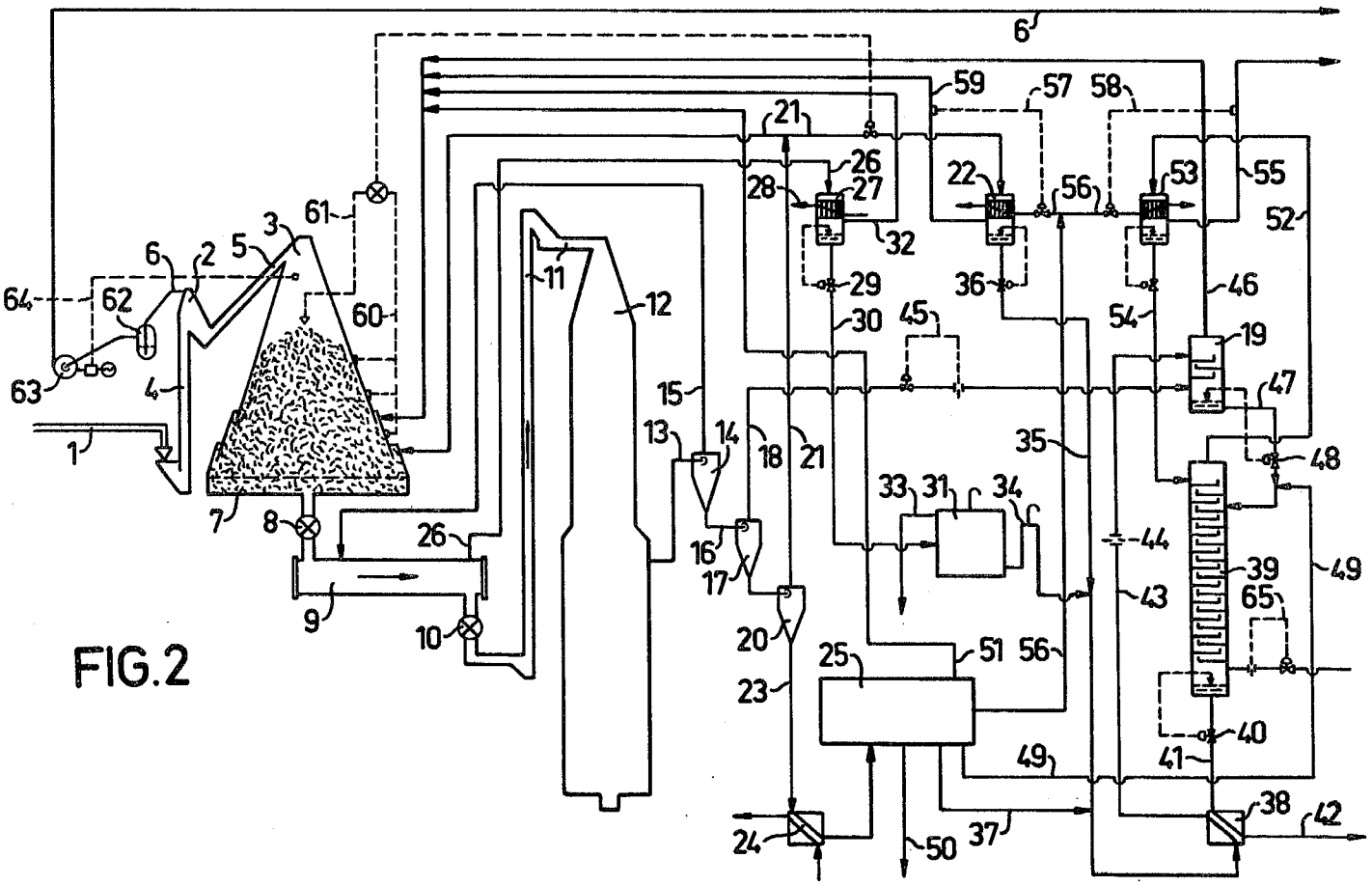
FIG. 2 shows diagrammatically an arrangement in accordance with the present invention in continuous cooking.

According to FIG. 2 cellulose material in the form of chips is conveyed by a conveyor 1 to a feed device 2 which introduces the chips into the upper part of a closed storage container 3. The feed device comprises two screw feeders 4 and 5, situated one after the other, a pipe 6 intended for ventilation being connected between the screw feeders. The screw feeders feed the chips in the form of a "plug" which prevents other air than that which is normally found in a bed of chips from being allowed to accompany the chips through the screw feeder 4 and gas from the storage container 3 is prevented from flowing freely through the screw feeder 5. As a result of the fact that the pressure in the vent 6 is kept lower than in the storage container 3, the air in the screw feeder 4 is prevented from accompanying the chips through the screw feeder 5 into the storage container 3. The gases from the storage container 3 are conveyed counter-currently to the chips to the vent 6, terpentine gases which may penetrate through the bed of chips into the container 3 in the event of disturbances in operation condensing in the chip plug in the screw feeder 5.

Disposed at the bottom of the storage container 3 is a discharge device 7. This device 7 feeds the chips via a cell feeder 8 to a steaming vessel 9. From the steaming vessel 9, the chips are fed through a cell feeder 10 and a conveyor device 11 to a continuous digester 12.

From the digester 12, extraction liquor is conveyed through a pipe 13 to a flash cyclone 14 where the pressure of the liquor is reduced, expansion steam passing via a pipeline 15 to the steaming vessel 9 and the liquor passing via a pipeline 16 to another flash cyclone 17. In the cyclone 17, some of the liquor pressure is reduced and the expansion steam of the liquor passes via a pipeline 18 to a terpentine driving-off column 19 and the liquor passes to a third flash cyclone 20, the flash steam of which is conveyed via a pipeline 21 either for heating chips in the storage container 3 or for hot-water production in a heat exchanger 22. The extraction steam from the heat exchanger 22 which contains a large amount of terpentine is conveyed via a pipeline 59 to the storage container 3, where the terpentine condenses on the chips and other uncondensed gases leave via the pipeline 6. The liquor from the flash cyclone 20 is conveyed via a pipeline 23 and a heat exchanger 24 to the evaporation section 25.

From the steaming vessel 9, the extraction gases are conveyed via a pipe 26 to a terpentine condenser 27, where the gases are cooled with cooling water from a pipe 28, a large proportion of the terpentine in the gases being condensed. The condensate is conveyed via a level-regulating member 29 and a pipeline 30 to a terpentine decanter 31. The uncondensed gases from the terpentine condenser 27 are conveyed via a pipeline 32 to the storage container 3 where the terpentine in the gases condenses on the chips and the evil-smelling gases leave via pipeline 6.

In the terpentine decanter 31, a large part of the terpentine is separated and leaves via a pipeline 33. The condensate which still contains terpentine is conveyed via a liquid lock 34 and a pipeline 35 together with condensate from the flash steam heat exchanger 22 and its level regulating member 36 and terpentine-rich condensate from the evaporation via a pipeline 37 to a heat exchanger 38, where it exchanges heat with the hot outgoing condensate from a methanol driving-off column 39, level regulating member 40 and pipeline 41. From the heat exchanger 38, the purified column-condensate is conveyed via a pipeline 42 to the manufacturing process and the terpentine-rich condensate is conveyed via a pipeline 43 and a quantity measuring member 44 to the terpentine driving-off column 19.

The flash steam from the cyclone 17, pipeline 18 with a quantity regulating member 45 drives off a large amount of terpentine and volatile organic sulphur compounds from the incoming condensate in the terpentine driving-off column 19, and the terpentine-rich gases are conveyed via a pipeline 46 to the storage container 3 where the terpentine condenses on the chips and the methanol-rich condensate is conveyed to the methanol driving-off column 39 via a pipeline 47 and a level regulating member 48. Condensate containing no or small amount of terpentine is also conveyed to the methanol driving-off column 39 from the evaporation 25 via a pipeline 49 and steam via a regulating member 65.

From the evaporation 25, condensate which is relatively pure from methanol and terpentine is conveyed via a pipeline 50 to the manufacturing process.

The gases from the condenser plant in the evaporation 25 are rich in terpentine, inter alia, and are conveyed via a pipeline 51 to the storage container 3 where the terpentine condenses on the chips and uncondensed gases leave via pipeline 6.

The extraction gases from the methanol driving-off column 39 are conveyed via a pipeline 52 to a heat exchanger 53 where the gases are cooled only so much that the water vapour condenses. The condensate is returned via a pipeline 54 to the driving-off column 39 and the methanol-rich gases leave via a pipeline 55 for burning.

Heated cooling water from the evaporation 25 is used as cooling water for the heat exchangers 22 and 53 via a pipeline 56 with a temperature regulating member 57 and 58.

The functions in the storage container 3 are controlled in the following manner.

The chips are heated mainly by expansion steam from the flash cyclone 20. The amount of steam for the storage container 3 is regulated in such a manner that the amount of steam for the heat exchanger 22 is regulated so that a heated zone in the container 3 is always maintained below the level of the chips in the container. The position of the heated zone is indicated by temperature sensers 60 and the level of the chips in the container is indicated by a level control member 61. In this manner terpentine gases are prevented from being able to leave the chips in the storage container 3 to the gas space of the container.

Of the other gases containing terpentine which are introduced into the storage container 3, those with a low temperature can be introduced in the bed of chips at a level which lies above the heated zone but below the surface of the bed.

The uncondensed gases which collect in the storage container 3 are conveyed counter-currently to the stream of chips in the screw feeder 5 as a result of the fact that the pressure in the gas collecting space between the screw feeders 4 and 5 is kept lower than in the storage container 3. At the same time, the effect is achieved that air from the screw feeder 4 is prevented from being conveyed with the chips through the screw feeder 5 to the storage container 3.

If chips hang in the storage container 3, for example, when cavities occur in the bed of chips, it may happen that terpentine gases momentarily penetrate through the bed of chips. The terpentine in the gases condenses on the chips in the "chip plug" in the screw feeder 5, the risk of explosion which would occur if air should be allowed to flow into the storage container 3 being avoided.

Since finely divided cellulose material, dust and shavings, can accompany the gases to the pipe 6, which may then be blocked, it is advisable to rinse the gases with liquid, for example with liquor which is used in the cooking process. The liquid is flushed through the pipe 6 as close to its intake as possible, and the liquid flows with the gases to a liquid lock 62, the purpose of which, apart from the above-mentioned, is to limit the damage which may occur in the event of such a faulty manoeuvre in the plant that an explosion occurs, despite the precautions described above to exclude the risk of explosion. The liquid which is conveyed into the liquid lock 62 spreads to a collecting cistern from which it can be re-used.

The gases which are conveyed away from the storage container 3 are conveyed away for destruction by a blower or pump 63 which regulates the pressure in the storage container 3 by means of a pressure regulating member 64. Since the gases may momentarily be explosive on restarting of the plant or in the event of a faulty manoeuvre, the conveyor devices should be so designed that spark formation cannot occur in the stream of gas.

We claim:

1. A method for producing chemical pulp by cooking cellulosic material containing terpentine comprising feeding said cellulosic material into a storage container so as to produce a bed of said cellulosic material therein, transporting said cellulosic material from said storage container into a digester, cooking said cellulosic material in said digester so as to produce a cooking liquor containing terpentine therein, removing said cooking liquor from said digester, producing expansion steam containing terpentine from said cooking liquor, introducing at least a portion of said expansion steam into the lower portion of said bed of cellulosic material in said storage container so as to transfer a substantial portion of the heat and terpentine contents of said expansion steam to said cellulosic material and produce a heated zone therein, regulating the flow of said expansion steam introduced into said bed of cellulosic material so that said heated zone is maintined below the surface of said bed, and withdrawing uncondensed gases from said storage container countercurrently to the flow of said cellulosic material into said storage container so as to prevent the entry of air contained in said cellulosic material into said storage container.

2. The method of claim 1 wherein said uncondensed gases withdrawn from said storage container are combusted.

3. The method of claim 1 wherein said cooking is carried out in batches in said digester, and wherein said cooked cellulosic material and said cooking liquor are withdrawn from said digester into a pulp container where said cooking liquor is expanded and said expansion steam is separated therefrom.

4. The method of claim 3 wherein said expansion steam separated from said digester is divided into a first expansion steam portion and a second expansion steam portion, said first expansion steam portion being introduced into said lower portion of said bed of cellulosic material.

5. The method of claim 4 wherein said second expansion steam portion is condensed in a condenser, and wherein said condensate is collected in a condensate container.

6. The method of claim 5 wherein uncondensed gases from said condensate container are introduced into said storage container.

7. The method of claim 6 wherein said uncondensed gases from said condensate container are introduced into said storage container along with said first expansion steam portion.

8. The method of claim 6 wherein said uncondensed gases from said condensate container are introduced into said storage container at a point above the point of introduction of said first expansion steam portion.

9. The method of claim 4 wherein the point of introduction of said first expansion steam portion into said storage container is selected on the basis of the steam content of said gaseous streams with lower steam contents being introduced at higher levels within said bed.

10. The method of claim 5 wherein said condensate container includes a liquid lock to prevent said uncondensed gases from flowing out of said condensate container into the atmosphere while at the same time air is prevented from flowing into said condensate container.

11. The method of claim 10 including supplying liquid to said liquid lock so as to fill said liquid lock and to prevent blocking of said liquid lock with said cellulosic material.

12. The method of claim 1 including recovering said terpentine from steam withdrawn from said digester, and returning any uncondensed gases produced during said recovery step to said storage container.

13. The method of claim 1 wherein said cooking is carried out continuously, and including steaming said cellulosic material transported from said storage container prior to said cooking.

14. The method of claim 13 wherein said expansion steam is produced from said cooking liquor in a plurality of stages, so as to produce a first expansion steam portion and a second expansion steam portion, said first expansion steam portion being introduced into the lower portion of said bed of cellulosic material, and said second expansion steam portion being used for steaming said cellulosic material prior to its entry into said digester.

15. The method of claim 14 wherein uncondensed gases containing terpentine are produced from said cooking liquor and are introduced into said storage container.

16. The method of claim 15 wherein said uncondensed gases are introduced into said storage container at a level above the heated zone in said bed but below the surface of said bed of cellulosic material.

17. The method of claim 14 wherein said first expansion steam portion is divided into a third expansion steam portion and a fourth expansion steam portion, said third expansion steam portion being introduced into the lower portion of said bed of cellulosic material and said fourth expansion steam portion being condensed to produce a condensate therefrom.

18. The method of claim 17 wherein uncondensed terpentine is removed from said condensate in a column wherein said condensate is contacted with steam.

* * * * *